US007343129B2

(12) United States Patent
Ahn et al.

(10) Patent No.: US 7,343,129 B2
(45) Date of Patent: Mar. 11, 2008

(54) IMAGE FORMING APPARATUS

(75) Inventors: Byeong-hwa Ahn, Seongnam-si (KR); Heung-sup Jeong, Suwon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 372 days.

(21) Appl. No.: 11/194,573

(22) Filed: Aug. 2, 2005

(65) Prior Publication Data

US 2006/0083550 A1 Apr. 20, 2006

(30) Foreign Application Priority Data

Oct. 15, 2004 (KR) ..... 10-2004-0082566

(51) Int. Cl.
*G03G 15/01* (2006.01)
*G03G 15/00* (2006.01)

(52) U.S. Cl. ..... 399/303; 399/411

(58) Field of Classification Search ..... 399/167, 399/121, 411, 303, 313
See application file for complete search history.

(56) References Cited

U.S. PATENT DOCUMENTS 5,119,141 A * 6/1992 Bhagat ..... 399/313
6,909,866 B2 * 6/2005 Kawai ..... 399/167

FOREIGN PATENT DOCUMENTS

| | | |
|---|---|---|
| JP | 62-192763 | 8/1987 |
| JP | 06-149119 | 5/1994 |
| JP | 2000-056620 | 2/2000 |
| JP | 2001-022188 | 1/2001 |
| JP | 2003-137450 | 5/2003 |

* cited by examiner

*Primary Examiner*—Susan Lee
(74) *Attorney, Agent, or Firm*—Roylance, Abrams, Berdo & Goodman, LLP

(57) ABSTRACT

An image forming apparatus includes a shaft, a shaft support portion rotatably supporting the shaft, a shaft gear provided at an end portion of the shaft in a lengthwise direction, and a first gear engaged with the shaft gear and rotating the shaft gear. The rotation of the first gear applies a force acting toward the shaft support potion and the shaft contacts the shaft support portion by the force during rotation so that vibration of the shaft is restricted. An image forming apparatus includes a case having a door that can be opened and closed, a shaft provided in the case, a shaft support portion rotatably supporting the shaft, a shaft gear provided at an end portion of the shaft in a lengthwise direction, and a first gear engaged with the shaft gear and rotating the shaft gear. The first gear is engaged with the shaft gear when the door is closed and disengaged from the shaft gear when the door is open.

18 Claims, 5 Drawing Sheets

IMAGE FORMING APPARATUS

CROSS-REFERENCE TO RELATED APPLICATION

This application claims the benefit under 35 U.S.C. § 119(a) of Korean Patent Application No. 10-2004-0082566, filed on Oct. 15, 2004, in the Korean Intellectual Property Office, the entire disclosure of which is hereby incorporated by reference.

BACKGROUND OF THE INVENTION

1. Field of the Invention

The present invention relates to an image forming apparatus. More particularly, the present invention relates to an image forming apparatus having a structure that restricts the vibration of a rotating shaft, thus improving print quality.

2. Description of the Related Art

In general, image forming apparatuses such as printers and photocopiers for printing images on print papers can be classified according to the method used to form an image. One type of image forming apparatuses is an electrophotographic image forming apparatus. In this type of apparatus, light is scanned onto a photosensitive medium charged to a predetermined electric potential to form an electrostatic latent image on an outer circumferential surface of the photosensitive medium. A developing agent such as toner is provided to the electrostatic latent image to develop the electrostatic latent image into a visible image. The developed image is transferred to a print medium and then fused thereon so that a desired image is printed.

The process of forming an image in an electrophotographic image forming apparatus typically includes a step of transferring an image developed on the photosensitive medium to a print medium. The image forming apparatus may include a transfer belt to transfer the print medium to a transfer position. The transfer belt is supported by a shaft which is rotated by the rotational power of a driving source, such as a motor.

FIG. 1 is a front view illustrating a gear assembly in a conventional image forming apparatus. The gear assembly transfers the rotational power of the drive source to the shaft supporting the transfer belt.

Referring to FIG. 1, the gear assembly includes a shaft gear 16 provided at an end portion of the shaft 20, a drive gear 14 engaged with the shaft gear 16, and a motor gear 12 fixed to the motor shaft 10 of a motor (not shown) that is a drive source and engaged with the drive gear 14. The shaft 20 is installed at a shaft support portion 6 of a frame 5 for the circulation of the transfer belt (not shown). When a door 2 of the image forming apparatus is open, the shaft 20 moved along a guide groove 7 formed in the frame 5 and is separated from the frame 5.

During the image forming process, the motor shaft 10 and the motor gear 12 rotate counterclockwise while the drive gear 14 engaged with the motor gear 12 rotates clockwise. The shaft gear 16 engaged with the drive gear 14 and the shaft 20 rotate counterclockwise.

For easy installation/detachment of the shaft 20, the shaft support portion 6 is slightly larger than the shaft 20. Thus, the shaft support portion 6 supports a lower surface and a side surface of the shaft 20, and a slight gap G is formed between the shaft 20 and an upper surface of the shaft support portion 6. Due to the rotational force of the drive gear 14 and pressure acting on the gear teeth of the gears 14 and 16 which are engaged with each other, a force F acts on the shaft gear 16 and the shaft 20 in a direction along a tangential line between the shaft gear 16 and the drive gear 14. The direction of the force F is gradually inclined upwardly, as shown in the drawing.

The amount of the force F can change according to a change in load of the transfer belt. Due to the change in the amount of the force F, the shaft 20 can shake in the shaft support portion 6. The vibration of the shaft 20 makes the image transfer process unstable, which results in a deterioration in the quality of a printed image.

Accordingly, there is a need for an image forming apparatus with an improved gear assembly which is more stable and produces improved quality images.

SUMMARY OF THE INVENTION

An aspect of the present invention is to solve at least the above problems and/or disadvantages and to provide at least the advantages described below. Accordingly, an aspect of the present invention is to provide an image forming apparatus which can restrict the vibration of a rotation shaft.

According to an aspect of the present invention, an image forming apparatus comprises a shaft and a shaft support portion rotatably supporting the shaft. A shaft gear is provided at an end portion of the shaft in a lengthwise direction. A first gear is engaged with the shaft gear and rotates the shaft gear. The rotation of the first gear applies a force that acts toward the shaft support portion. The force causes the shaft to contact the shaft support portion so that vibration of the shaft is restricted.

In another aspect of the invention, the outer circumferential surface of the shaft is divided into a pair of semicircular outer circumferential surfaces by an imaginary linear line connecting the center of the shaft and the center of the first gear. The support portion supports one of the pair of outer circumferential surfaces. The rotational direction of the first gear is determined such that the shaft gear and the shaft rotating by the rotation of the first gear press the shaft support portion.

In a further aspect of the invention, the apparatus further comprises a case with a door that can be open and closed, a second gear engaged with the first gear and rotating the first gear, and a swing bracket supporting the first gear and the second gear and pivoting around the center of rotation of the second gear. When the door is open, the swing bracket pivots in a direction in which the first gear and the shaft gear are disengaged.

In one more aspect of the invention, the swing bracket is elastically biased in a direction in which the first gear and the shaft gear are disengaged.

In yet another aspect of the invention, when the door is closed, the swing bracket is pushed by the door to pivot in a direction in which the first gear and the shaft gear are engaged.

In still yet another aspect of the invention, the shaft supports a belt with a print medium attached thereon to be transferred.

According to another aspect of the present invention, an image forming apparatus comprises a case having a door that can be open and closed. A shaft is provided in the case, and a shaft support portion rotatably supports the shaft. A shaft gear is provided at an end portion of the shaft in a lengthwise direction, and a first gear is engaged with the shaft gear and rotates the shaft gear. The first gear is engaged with the shaft gear when the door is closed and disengaged from the shaft gear when the door is open.

In another aspect of the invention, the apparatus further comprises a second gear engaged with the first gear and rotating the first gear, and a swing bracket supporting the first and second gears and pivoting around the center of rotation of the second gear. The swing bracket pivots in a direction in which the first gear and the shaft gear are disengaged when the door is open.

In a further aspect of the invention, the swing bracket is elastically biased in a direction in which the first gear and the shaft gear are disengaged.

In one more aspect of the invention, when the door is closed, the swing bracket is pushed by the door to pivot in a direction in which the first gear and the shaft gear are engaged.

In yet another aspect of the invention, the shaft supports a belt with a print medium attached thereon to be transferred.

BRIEF DESCRIPTION OF THE DRAWINGS

The above and other objects, features, and advantages of certain embodiments of the present invention will be more apparent from the following description taken in conjunction with the accompanying drawings, in which.

Throughout the drawings, the same drawing reference numerals will be understood to refer to the same elements, features, and structures.

DETAILED DESCRIPTION OF EXEMPLARY EMBODIMENT

The matters defined in the description such as a detailed construction and elements are provided to assist in a comprehensive understanding of the embodiments of the invention. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

Figure 1:
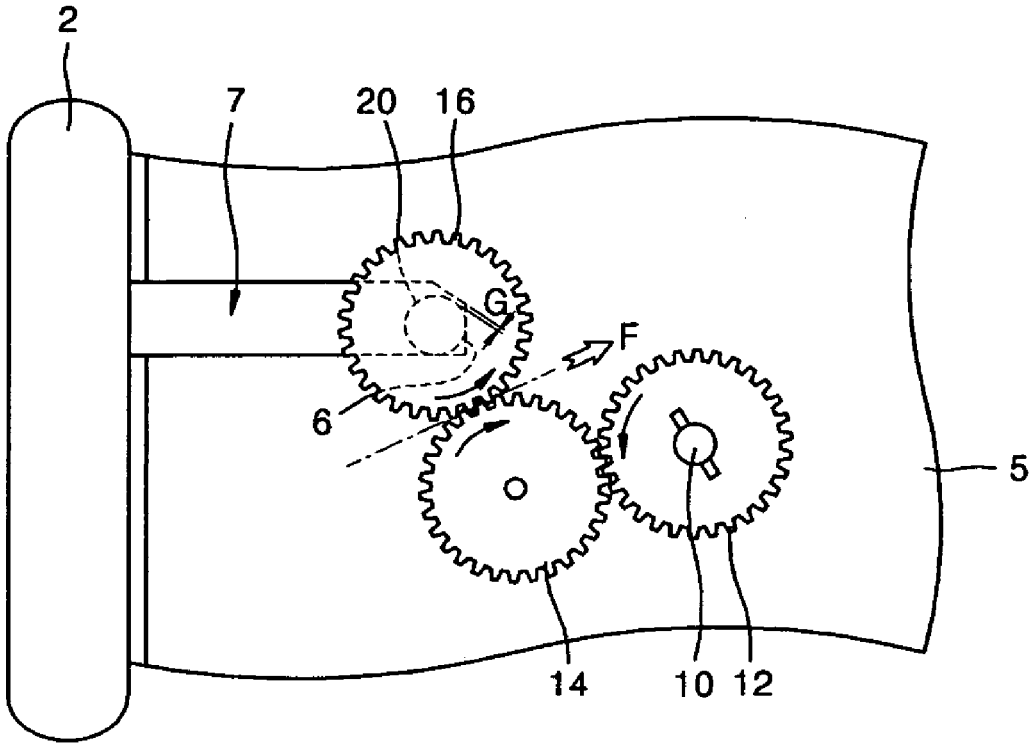
FIG. 1 (PRIOR ART)
FIG. 1 is a front view of a conventional gear assembly in an image forming apparatus.
Figure 2:
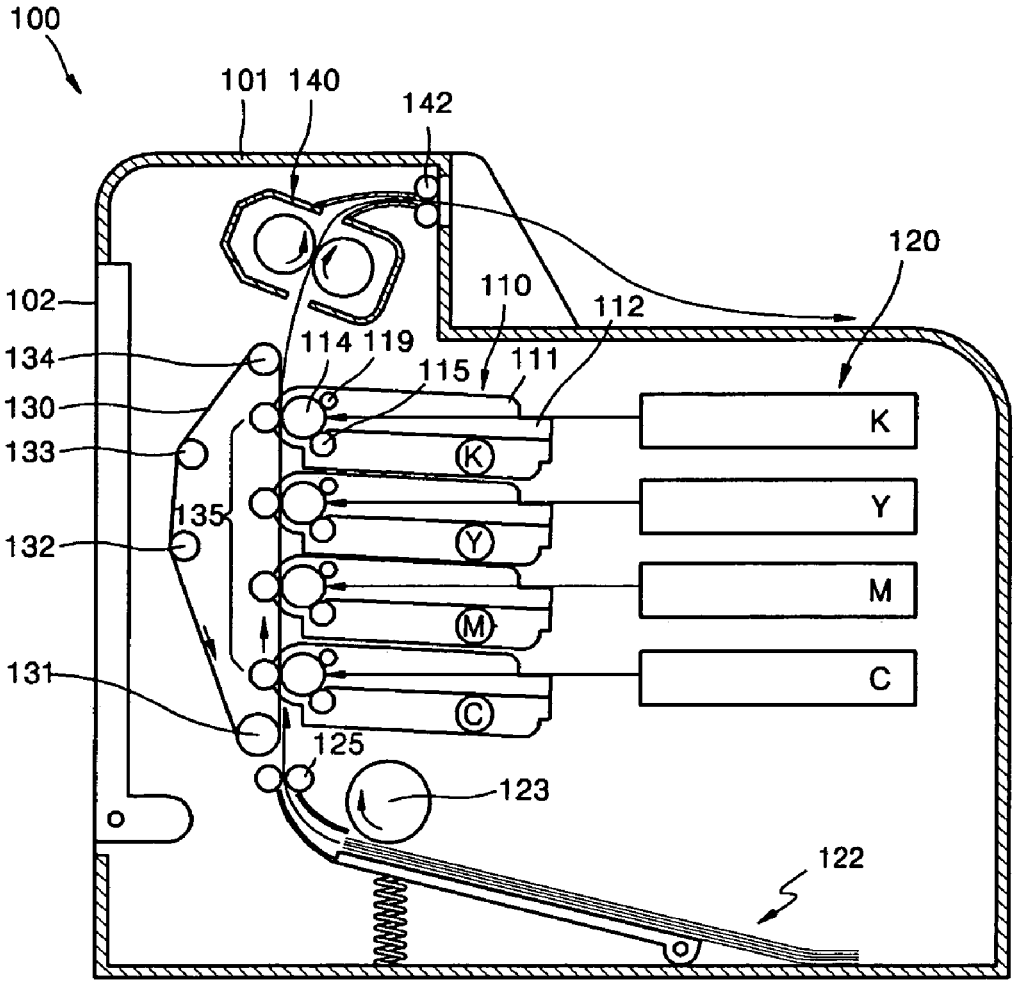
FIG. 2 is a cross-sectional view of an image forming apparatus according to an embodiment of the present invention.

Referring to FIG. 2, the image forming apparatus 100 according to an exemplary embodiment of the present invention is an electrophotographic color printer capable of printing a color image. The image forming apparatus 100 includes a case 101 with four developing units 110, four optical scanning units 120, a transfer belt 130, four transfer rollers 135, and a fuser 140. The image forming apparatus 100 further includes a cassette 122 where sheets of paper are loaded, a pickup roller 123 picking up the sheets of paper one by one from the cassette 122, a transfer roller 125 transferring the picked up paper, and an ejecting roller 142 ejecting paper with a printed image out of the case 101.

The developing units 110 are cartridge type developing units which are replaced with new ones when toner (that is a developing agent) is consumed. In the embodiment shown in FIG. 2, four developing units 110C, 110M, 110Y, and 110K contain different colors for printing a color image, for example, cyan (C), magenta (M), yellow (Y), and black (K). When a door 102 at the side of the case 101 is open, a shaft 134 supporting the transfer belt 130 is pulled toward the door 102 and the transfer belt 130 is arranged horizontally. This forms a path through which the developing units 110C, 110M, 110Y, and 110K can be inserted or removed. Accordingly, developing units 110C, 110M, 110Y, and 110K which are depleted can be exchanged through the path.

The transfer belt 130 is supported by a plurality of shafts 131, 132, 133, and 134 and circulates around the shafts. In the exemplary embodiment, the four optical scanner units 120 correspond to the four developing units 110C, 110M, 110Y, and 110K. Each of the optical scanning units 120C, 120M, 120Y, and 120K scans light rays corresponding to image information of colors such as cyan (C), magenta (M), yellow (Y), and black (K) onto a photosensitive medium 114 installed in a housing 111 of each of the developing units 110C, 110M, 110Y, and 110K. Laser scanning units using a laser diode as a light source can be used as the optical scanning units 120C, 120M, 120Y, and 120K.

Each of the developing units 110C, 110M, 110Y, and 110K includes the photosensitive drum 114 and a developing roller 115 in the housing 111. The part of the outer circumferential surface of the photosensitive drum 114 that faces the transfer belt 130 during printing of an image is exposed outside the housing 111 to allow transfer of the image. Also, each of the developing units 110C, 110M, 110Y, and 110K includes a charge roller 119. A charge bias is applied to the charge roller 119 to charge the outer circumferential surface of the photosensitive drum 114 to a uniform electric potential. The toner adheres to the outer circumferential surface of the developing roller 115 and is supplied to the photosensitive drum 114. A developing bias to supply the toner to the photosensitive drum 114 is applied to the developing roller 115. Also, although not shown, a supply roller supplying the toner to the developing roller 115, a doctor blade restricting the amount of the toner adhering to the developing roller 115, and a conveyer belt type agitator which transfers the toner accommodated in the housing 111 toward the supply roller, are further provided in the housing 111 of the each of the developing units 110C, 110M, 110Y, and 110K. An opening 112 forming a path for the light ray scanned by the optical scanning units 120C, 120M, 120Y, and 120K to arrive at the photosensitive drum 114 is formed at each of the developing units 110C, 110M, 110Y, and 110K.

The four transfer rollers 135 are each arranged at a position facing the photosensitive drum 114 of each of the developing units 110C, 110M, 110Y, and 110K. The transfer belt 130 is interposed between the transfer rollers and developing units. A transfer bias is applied to the transfer roller 135.

The process of forming a color image of the electrophotographic image forming apparatus according to the exemplary embodiment described above is described below.

The photosensitive drum 114 of each of the developing units 110C, 110M, 110Y, and 110K is charged to a uniform electric potential by the charge bias applied to the charge roller 119. The four optical scanning units 120C, 120M, 120Y, and 120K scan light rays corresponding to image information of cyan (C), magenta (M), yellow (Y), and black (K) colors onto the photosensitive drum 114 of each of the developing units 110C, 110M, 110Y, and 110K through the opening 112, so that an electrostatic latent image is formed on the outer circumferential surface of the photosensitive drum 114. The developing bias is applied to the developing roller 115 so that toner is transferred from the developing roller 115 to the outer circumferential surface of the photosensitive drum 114. Accordingly, a visible image of each of the cyan (C), magenta (M), yellow (Y), and black (K) colors is formed on the outer circumferential surface of the photosensitive drum 114 of each of the developing units 110C, 110M, 110Y, and 110K.

The paper in the cassette 122 is picked up by the pickup roller 123 and transferred by the transfer roller 125 toward the transfer belt 130. The paper adheres to the surface of the transfer belt 130 by an electrostatic force and is transferred at the same speed as the circulation speed of the transfer belt 130.

A leading end of the paper which is transferred by being attached to the transfer belt 130 arrives at a transfer nip when a leading end of the visible image of the cyan (C) color formed on the outer circumferential surface of the photosensitive drum 114 of the developing unit 110C of the cyan (C) color disposed at the lowermost position arrives at the nip facing the transfer roller 135. Then, when the transfer bias is applied to the transfer roller 135, the visible image formed on the photosensitive drum 114 is transferred to the paper. As the paper is continuously transferred, the visible images of the magenta (M), yellow (Y), and black (K) colors formed on the outer circumferential surface of the photosensitive drum 114 of the other developing units 110M, 110Y, and 110K are sequentially transferred to the paper overlapping one another so that a color visible image is formed on the paper. The fuser 140 applies heat and pressure to the color visible image formed on the paper so that the image is fixed on the paper. The paper with the fixed image is ejected out of the case 101 by the ejecting roller 142.

The shaft 134 supporting the transfer belt 130 is rotated by the rotational power of a motor (not shown) that is a drive source. A gear assembly 150 to transfer the rotational power of the motor to the shaft 134 is provided in the case 101 of the image forming apparatus 100.

Figure 3:
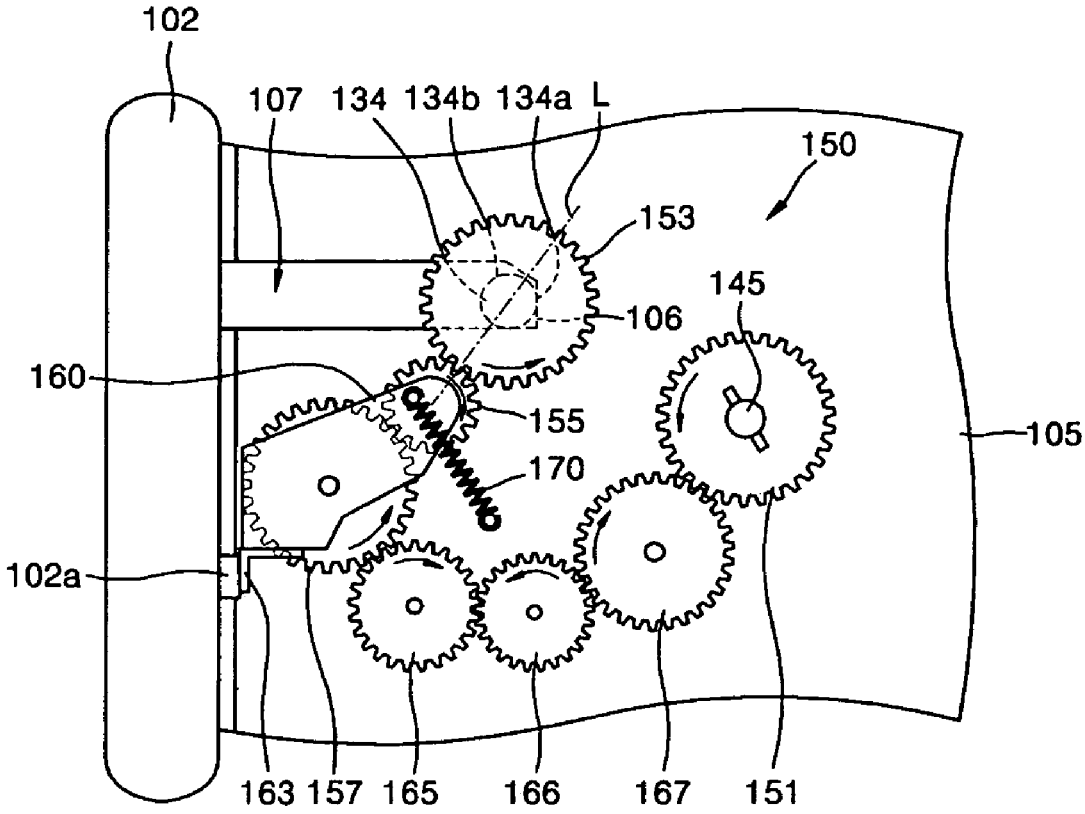
FIG. 3 is a front view of the gear assembly in the image forming apparatus of FIG. 2 when the door is closed.
Figure 4:
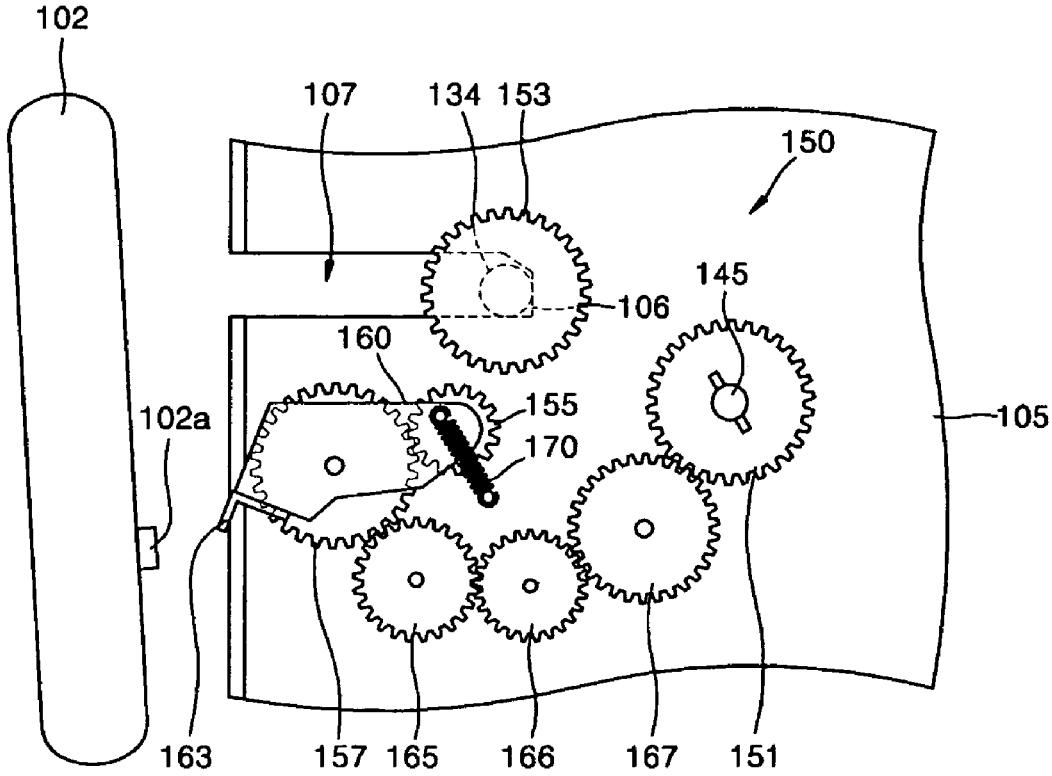
FIG. 4 is a front view of the gear assembly in the image forming apparatus of FIG. 2 when the door is open.

Referring to FIGS. 3 and 4, the gear assembly 150 includes a shaft gear 153 provided at one end portion of the shaft 134 supporting the transfer belt 130, a first gear 155 engaged with the shaft gear 153, and a second gear 157 engaged with the first gear 155. The gear assembly 150 further includes a motor gear 151 fixed to a motor shaft 145 of the motor and third, fourth, and fifth gears 165, 166, and 167 arranged in series from the second gear 157 to the motor gear 151 and engaged with one another. The third, fourth, and fifth gears 165, 166, and 167 are rotatably installed to a frame 105 provided inside the case 101.

The shaft 134 is rotatably installed at a shaft support portion 106 which is formed on the frame 105. The outer circumferential surface of the shaft 134 can be divided into a pair of semicircular outer circumferential surfaces 134*a* and 134*b* by an imaginary linear line L that connects the center of the shaft 134 and the center of the first gear 155. The shaft support portion 106 supports the shaft 134 such that the outer circumferential surface 134*a* contacts the shaft support portion 106. When the door 102 of the image forming apparatus 100 is open and the shaft 134 is pulled toward the door 102, the shaft 134 is moved along a guide groove 107 formed in the frame 105 to move away from the frame 105.

The first and second gears 155 and 157 are disposed under the shaft gear 153 and are rotatably installed on a swing bracket 160. The swing bracket 160 supports the first and second gears 155 and 157 and is pivotably installed to the frame 105. The center of pivot of the swing bracket 160 is set to match the center of rotation of the second gear 157. One end of the swing bracket 160 is elastically biased by a spring 170 coupled to the frame 105 in a direction in which the first gear 155 descends to disengage the first gear 155 and the shaft gear 153.

The other, lower end portion of the swing bracket 160 has a receiver 163. The receiver 163 is pressed by a pusher 102*a* protruding from an inner surface of the door 102. When the receiver 163 is pressed and pushed, the swing bracket 160 rotates to cause the first gear 155 to ascend so that the first gear 155 and the shaft gear 153 are engaged with each other.

When the shaft 134 is installed on the shaft support portion 106 of the frame 105 and the door 102 is closed, the gears are engaged in series from the motor gear 151 to the shaft gear 153, as shown in FIG. 3. Thus, as the motor shaft 145 rotates in the image forming process, the rotational power is transferred to the shaft 134 so that the shaft 134 is rotated and the transfer belt 130 circulates.

When the door 102 is open, however, as shown in FIG. 4, the pusher 102*a* retreats and no longer presses the receiver 163 so that the swing bracket 160 pivots in a direction in which the first gear descends due to the elasticity of the spring 170. Accordingly, the first gear 155 and the shaft gear 134 are disengaged so that a user can easily pull the shaft 134 out from the frame 105.

Figure 5:
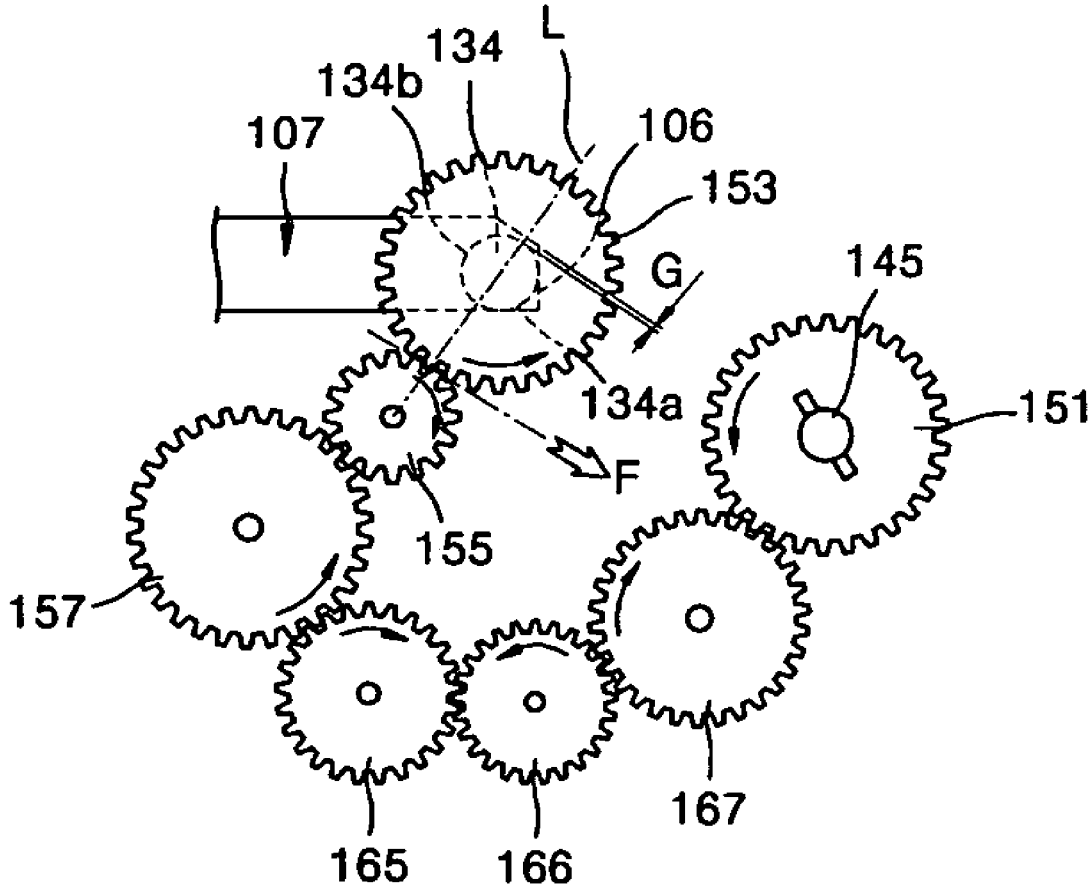
FIG. 5 is a front view of the connection structure of the gear assembly provided in the image forming apparatus of FIG. 2 and the force acting on the shaft gear.

Referring to FIG. 5, the shaft support portion 106 is designed to be slightly larger than the shaft 134. When the shaft 134 is installed at the shaft support portion 106, the shaft support portion 106 supports the semicircular outer circumferential surface 134*a* of the shaft 134 and a slight gap G is formed on the upper surface of the shaft 134.

When the motor shaft 145 rotates counterclockwise and the first gear 155 is engaged with the shaft gear 153, the shaft gear 153 rotates counterclockwise and the first gear 155 rotates clockwise. A force F acts on the shaft gear 153 and the shaft 134 due to the rotational force of the first gear 155 and the pressure from the gear teeth of the gears 153 and 155 which are engaged with each other. The force F acts in a tangential direction between the shaft gear 153 and the first gear 155, which is a slightly declined direction opposite to the door 102. Thus, the force F makes the outer circumferential surface 134*a* of the shaft 134 contact the shaft support portion 106 so that the vibration of the shaft 134 can be restricted in spite of the gap G. That is, the shaft 134 contacts the shaft support portion 106 without any gaps in the direction that the force F acts. Thus, even when the force F acts, the shaft 134 does not shake or vibrate. Accordingly, the transfer belt 130 supported by the shaft 134 during the image forming process does not shake.

As described above, an image forming apparatus according to the present invention reduces the vibration of the transfer belt transferring paper so that image transfer is stable and the quality of a printed image is improved. Also, the stability of the shaft is improved by the power transfer unit itself without providing an additional component, so manufacturing costs are reduced.

While the invention has been shown and described with reference to certain embodiments thereof, it will be understood by those skilled in the art that various changes in form and details may be made therein without departing from the spirit and scope of the invention as defined by the appended claims.

What is claimed is:

1. An image forming apparatus comprising:

a shaft;

a shaft support portion rotatably supporting the shaft;

a shaft gear provided at an end portion of the shaft in a lengthwise direction; and a first gear engaged with the shaft gear and rotating the shaft gear, wherein the rotation of the first gear applies a force acting toward the shaft support portion to the shaft and the shaft contacts the shaft support portion by the force during rotation.

2. The apparatus as claimed in claim 1, wherein a vibration of the shaft is restricted.

3. The apparatus as claimed in claim 1, wherein the outer circumferential surface of the shaft is divided into a pair of semicircular outer circumferential surfaces by an imaginary linear line connecting the center of the shaft and the center of the first gear, and the shaft support portion supports one of the pair of semicircular outer circumferential surfaces, and the rotational direction of the first gear is determined such that the shaft gear and the shaft rotating by the rotation of the first gear press the shaft support portion.

4. The apparatus as claimed in claim 1, further comprising:

a case with a door that can be opened and closed;

a second gear engaged with the first gear and rotating the first gear; and a swing bracket supporting the first gear and the second gear and pivoting around the center of rotation of the second gear, wherein, when the door is open, the swing bracket pivots in a direction in which the first gear and the shaft gear are disengaged.

5. The apparatus as claimed in claim 4, wherein the swing bracket is elastically biased in a direction in which the first gear and the shaft gear are disengaged.

6. The apparatus as claimed in claim 4, wherein, when the door is closed, the swing bracket is pushed by the door to pivot in a direction in which the first gear and the shaft gear are engaged.

7. The apparatus as claimed in claim 1, wherein the shaft supports a belt with a print medium attached thereon to be transferred.

8. An image forming apparatus comprising:

a case having a door that can be opened and closed;

a shaft provided in the case;

a shaft support portion rotatably supporting the shaft;

a shaft gear provided at an end portion of the shaft in a lengthwise direction; and a first gear engaged with the shaft gear and rotating the shaft gear, the first gear being engaged with the shaft gear when the door is closed and disengaged from the shaft gear when the door is open.

9. The apparatus as claimed in claim 8, further comprising:

a second gear engaged with the first gear and rotating the first gear; and a swing bracket supporting the first and second gears and pivoting around the center of rotation of the second gear, wherein the swing bracket pivots in a direction in which the first gear and the shaft gear are disengaged when the door is open.

10. The apparatus as claimed in claim 8, wherein the swing bracket is elastically biased in a direction in which the first gear and the shaft gear are disengaged.

11. The apparatus as claimed in claim 8, wherein, when the door is closed, the swing bracket is pushed by the door to pivot in a direction in which the first gear and the shaft gear are engaged.

12. The apparatus as claimed in claim 8, wherein the shaft supports a belt with a print medium attached thereon to be transferred.

13. An image forming apparatus comprising:

a frame with a shaft support portion;

a case attached to the frame, the case having a door that can be opened and closed;

a shaft rotatably supported in the shaft support portion;

a shaft gear provided at an end portion of the shaft; and a first gear engaged with the shaft gear and rotating the shaft gear, the first gear being engaged with the shaft gear when the door is closed and disengaged from the shaft gear when the door is open.

14. The apparatus as claimed in claim 13, further comprising:

a second gear engaged with the first gear and rotating the first gear; and a swing bracket supporting the first and second gears and pivoting around the center of rotation of the second gear, wherein the swing bracket pivots in a direction in which the first gear and the shaft gear are disengaged when the door is open.

15. The apparatus as claimed in claim 13, wherein a swing bracket is elastically biased in a direction in which the first gear and the shaft gear are disengaged.

16. The apparatus as claimed in claim 13, wherein, when the door is closed, a swing bracket is pushed by the door to pivot in a direction in which the first gear and the shaft gear are engaged.

17. The apparatus as claimed in claim 13, wherein the shaft supports a belt with a print medium attached thereon to be transferred.

18. The apparatus as claimed in claim 13, wherein the frame has a guide groove for guiding movement of the shaft.

* * * * *